US005152065A

United States Patent [19]

Harding

[11] Patent Number: 5,152,065

[45] Date of Patent: Oct. 6, 1992

[54] TOOL HEAD HAVING AN EASILY REPLACEABLE HANDLE ATTACHED THERETO

[76] Inventor: Alfred F. Harding, P.O. Box 7, Orleans, Calif. 95556

[21] Appl. No.: 732,785

[22] Filed: Jul. 19, 1991

[51] Int. Cl.[5] ..... B26B 23/00

[52] U.S. Cl. ..... 30/308.3; 81/489

[58] Field of Search ..... 30/308.1, 308.2, 308.3, 30/164.5, 164.6, 164.7, 164.8; 81/489, 491, 492; 16/114 R; 125/43

[56] References Cited

U.S. PATENT DOCUMENTS 1,515,715 11/1924 Zgol ..... 30/308.5 X

*Primary Examiner*—Douglas D. Watts

*Attorney, Agent, or Firm*—Robert J. Schaap

[57] ABSTRACT

The improved tool head of the invention is comprised of two separable members, namely, a main body and a removable section. Each member has an interior channel therein. In use, the two separable members mate to define the tool head while the channels of each member align to cooperatively define a cavity within the tool head. A tool handle is retained within the cavity. Replacement of the tool handle is executed by separating the removable section from the main body, thereby allowing removal of the handle from the aligned channels which define the cavity. The two members of the tool head are joined by bolts or screws such that one end of the tool handle is captured therebetween, within the cavity. Preferably, one or both channels provide teeth, ridges or similar protrusions which will grip the captured handle end to ensure that the handle is secured within the tool head.

18 Claims, 2 Drawing Sheets

TOOL HEAD HAVING AN EASILY REPLACEABLE HANDLE ATTACHED THERETO

BACKGROUND OF THE INVENTION

This invention relates generally to tools of the type having a tool head mounted upon a handle. More specifically, this invention relates to hand-held tools configured for striking hard surfaces (such as axes, hammers, picks, sledgehammers, etc.) or cutting (such as scythes, sickles, hatchets, etc.) that have handles (typically wooden) which may break with extended use, abuse or accidental misuse.

The longstanding, widespread problem which the present invention addresses is associated with tools used for delivering a striking blow upon a workpiece, as when one chops into a tree with an axe. The general category of hand-held tools intended for high impact encounters between the tool head (manipulated by a handle attached thereto) and a workpiece usually ultimately suffer handle damage or breakage. In such cases, it is more economical to replace merely the tool handle, rather than the entire tool. Unfortunately, most prior conventional tool heads are not easily removed from a broken tool handle. This is due in large part to the widespread practice of using wedges to attach a tool head to a tool handle. In this common attachment arrangement, the tool head is provided with a handle-receiving cavity during manufacturing. A wooden handle is then inserted within the cavity and is expanded into a tight fit therein by one or more wedges which are typically driven into the handle end accommodated within the tool head. Alternatively,.wedges may be driven into the cavity at locations between the handle and the tool head to create a snug fit by filling cavity gaps rather than by expanding the handle. Disadvantageously, these prior practices make it difficult to separate a tool head from its handle once said handle needs replaced. Usually, the wedges are originally pounded into place so tightly that removal by hand is extremely difficult, if not impossible. Typically, a captive wedge must be drilled out by power tools in order to free it from engagement with the tool head and handle. Since prior tool handles are not easily separated and discarded from prior tool heads, a worker can suffer significant nonproductive downtime while re-outfitting a broken tool with a new handle. The alternative, namely purchasing a completely new tool, is also disadvantageous because of the cost.

Thus, because labor intensive activities, such as construction and lumberjacking, can readily break a tool handle through repeated use and abuse, there exists a significant need for an improved tool head that joins to a tool handle in an engagement that readily allows handle replacement in an easy manner. The present invention fulfills these needs in a relatively inexpensive manner and provides further related advantages.

BRIEF DESCRIPTION OF THE DRAWINGS

The accompanying drawings illustrate the invention. In such drawings:

FIG. 4 illustrates a curved edge configuration provided on the removable plate for interlocking with a mating curved channel provided in the main tool head body, whereas FIG. 3 illustrates a squarish edge configuration on the removable plate that interlocks with a mating squarish channel provided in the main body.

DETAILED DESCRIPTION OF THE PREFERRED EMBODIMENT

Figure 1:
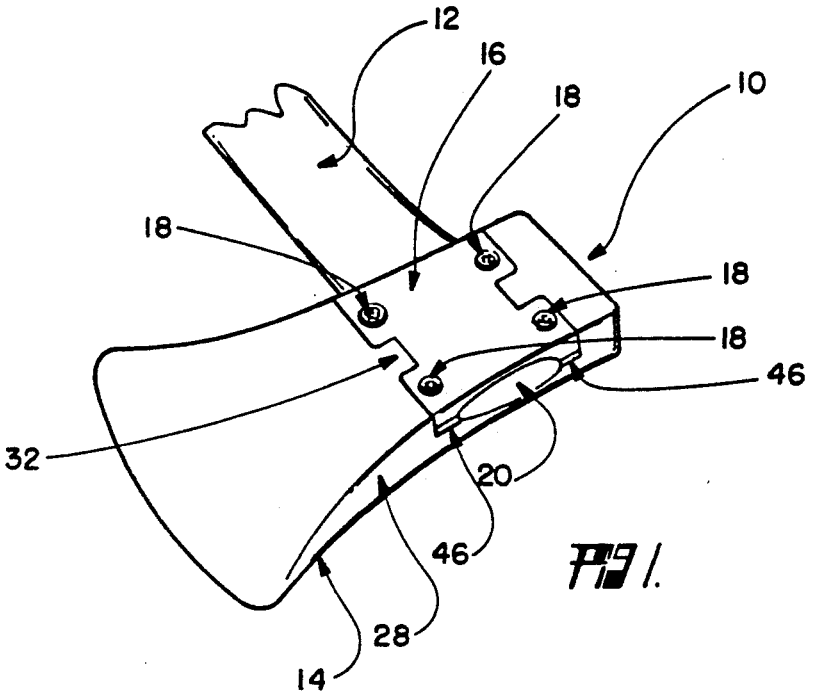
FIG. 1 is a perspective view of an axe embodying the invention, showing a handle having one end depicted in fragment and an opposite end that is retained within a cavity defined by a main tool head body and a removable plate secured thereto by screws.

As shown in the drawings for purposes of illustration, the present invention resides in an improve tool having a tool head fixed upon a tool handle by a removable plate that is separable from a main body of the tool head in order to allow for a broken tool handle to be easily and quickly replaced. The removable plate, and the main tool head body to which said plate is fastened, cooperatively grip the tool handle in a releasible manner which obviates the disadvantages associated with the prior practice of securing a tool head onto a wooden handle by driving one or more wedges into the handle in order to expand said handle into a tight fit within a cavity in the tool head.

It must be noted that the present invention, namely a tool head having a removable section which allows access to, and replacement of, a tool handle that is retained within said tool head by the attachment of the removable section thereto, is embodied herein in the illustrations of an axe tool. However, these illustrations are by way of example, rather than by way of limitation, in that, the main tool head body may also be configured as a hammer, hoe, sicle, etc. having a removable section that allows easy replacement of the handle associated with the main body. That is, any tool head that normally is fastened onto an elongated (typically wooden) handle may be manufactured to include the inventive features described hereinafter; thus, improved tools having a tool head configured differently than an axe head are considered to be within the spirit and scope of the present patent, provided that such other improved tools include the handle attachment arrangement (involving a removable tool head section) that is the focus of this invention.

In accordance with the present invention, an improved tool head 10 (FIG. 1) is provided attached to a tool handle 12 in an improved manner. In the present invention, the tool head 10 is comprised of a main body 14 that has a removable side plate 16 attached thereto by a plurality of bolts or screws 18. The side plate 16 and the main body 14 are shown joined in FIG. 1 to retain an end 20 of the handle 12 therebetween. To ensure a tight fit, the handle end 20 may be sized larger than the remainder of the handle 12.

Figure 2:
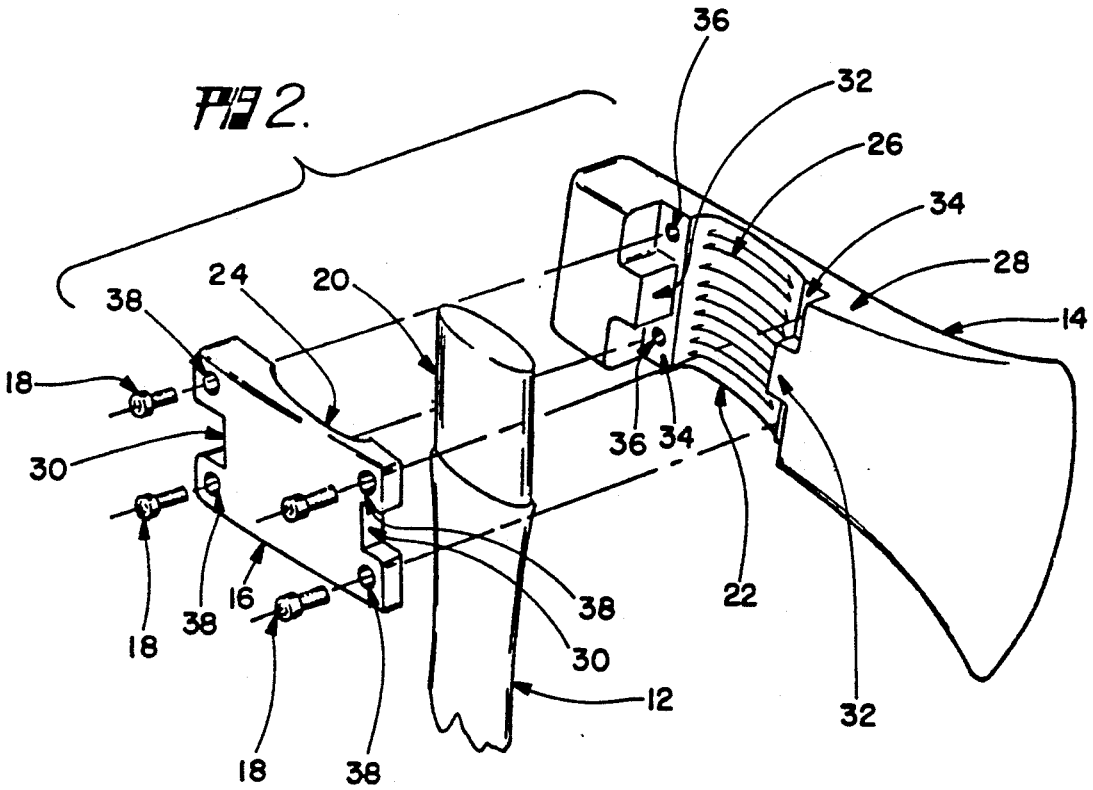
FIG. 2 is an enlarged exploded view of the axe of FIG. 1, with the handle having its distal end depicted in fragment, also showing the removable plate separated from the main tool head body to reveal a channel in said body having ridges for gripping a handle portion accommodated within said channel.

The exploded view of FIG. 2 illustrates that the improved tool head 10 is advantageously comprised of a minimum of components. FIG. 2 offers the best view of a first channel 22 that is provided in the main body 14, and a second channel 24 that is provided in the removable side plate 16. The main body 14 and the side plate 16 mate (as in FIG. 1) such that the first and second channels 22 and 24 cooperatively define a cavity that accommodates and retains the handle end 20.

Figure 3:
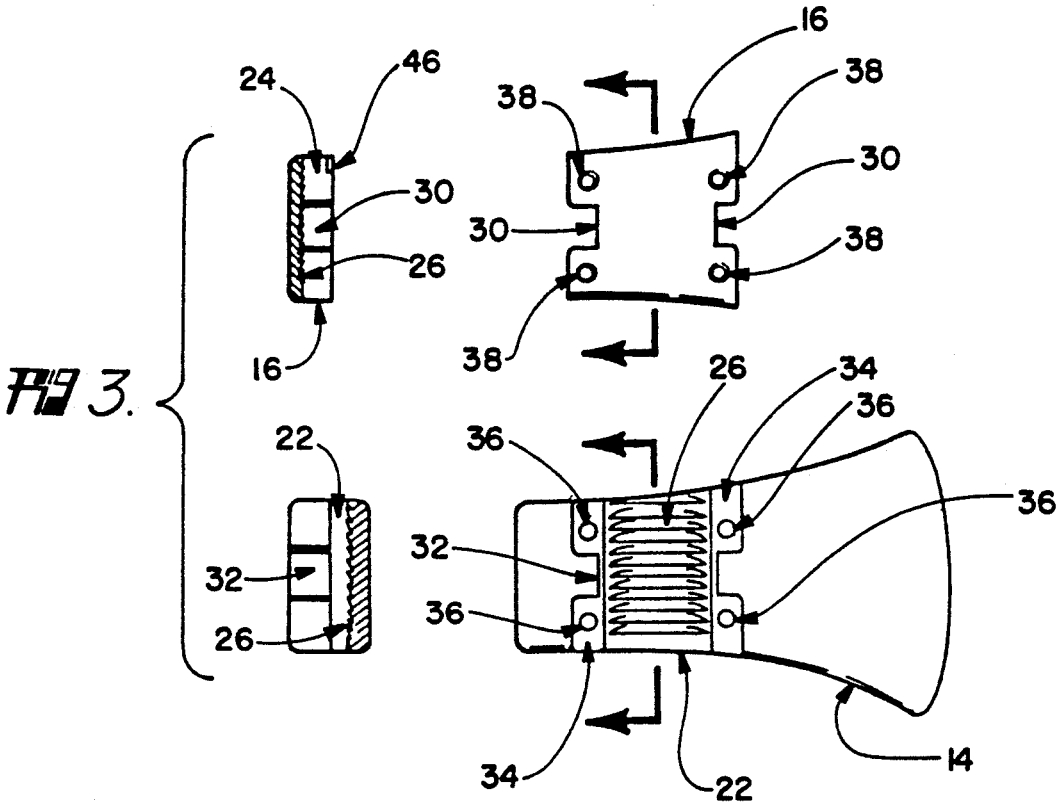
FIG. 3 presents side elevational views of the removable plate and the main tool head body of FIG. 2, and also presents cross sectional views of the removable plate and main body, with each cross sectional view being taken generally along the sight lines indicated by the arrows in each side elevational view, wherein the cross sectional views indicate the orientation of sharpened ridges located in complementary first and second channels in the main tool head body and the removable plate, respectively.
Figure 4:
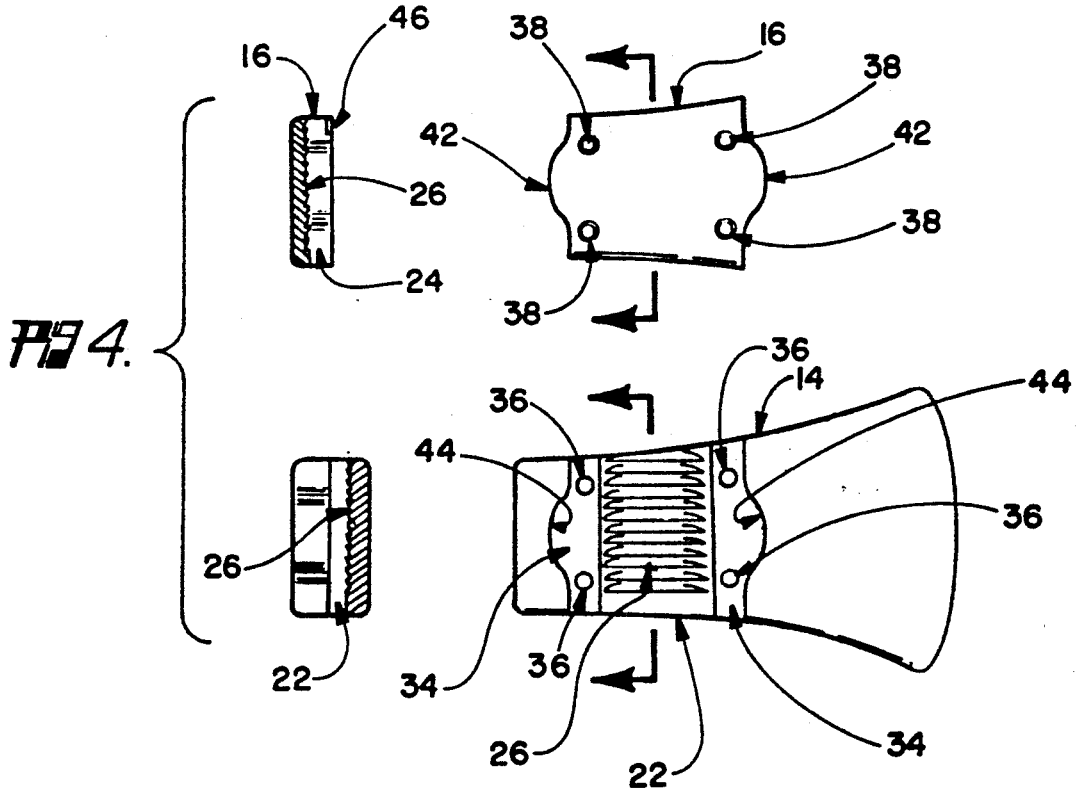
FIG. 4 presents side elevational views and cross sectional views of the removable plate and the main tool head body in a manner similar to FIG. 3, however

As best viewed in FIGS. 3 and 4, preferably, both channels 22 and 24 have a handle-contacting surface provided with a plurality of sharpened protrusions, teeth or ridges 26 extending outwardly therefrom. The handle 12 is, preferably, made of a sturdy nonmetallic material, such as wood, that will allow the protrusions or ridges 26 to bite into and grip the handle. The ridges 26 provide a preferred means for engaging the handle end 20, however, other engagement arrangements may be employed if desired. The motivation behind providing the ridges 26 within the channels 22 and 24 is to prevent the handle 12 from being pulled free from within its retaining cavity during use. Towards this end, the ridges 26 are angled upwardly (best seen in FIGS. 3 and 4) to point towards a top edge 28 of the main body 14. That is, the ridges 26 generally point towards the captured handle end 20 and point away from the free end of the handle 12. The free end of the handle 12 is opposite the handle end 20, is grasped for manipulation of the tool, and is unseen in FIGS. 1 and 2 because the handle 12 is shown in fragment in those views. The angled orientation of the ridges or protrusions 26 is especially designed to eliminate any tendency for the handle 12 to move in a direction away from the top edge 28 of the tool head 10 during use. Although the illustrated, preferred embodiment depicts both channels 22 and 24 as having ridges 26, the invention may alternatively be embodied such that channel 22 includes means for engaging the handle while channel 24 omits such means, or vice-versa.

The tool head 10 is comprised of a metallic material, preferably steel tempered for a sufficient hardness. The side plate 16 and the main body 14 are interlocked by a detente arrangement in order to prevent any movement of the side plate relative to the main body and to provide a more secure union of the side plate to the main body. FIGS. 1-3 illustrate one preferred detente arrangement wherein one or more rectangular slots 30 defined in side edges of the side plate 16 engage one or more rectangular tabs 32 provided on the main body 14. Note in FIGS. 2-4 that besides a sunken groove in the main body 14 which defines the channel 22, the main body 14 also has recessed portions 34 adjacent to the channel 22. These recessed portions 34 receive the interior face of the side plate 16 such that the exterior surfaces of the side plate will be aligned flush with the exterior surfaces of the main body 14. A plurality of threaded apertures 36 are provided in the recessed portion 34 of the main body 14. When the side plate 16 is mated with the main body 14, a plurality of holes 38 in the side plate align with the apertures 36 in the main body so that the side plate may be secured to the main body by the plurality of bolts or screws 18, each of which passes through a hole 38 and threads into an aperture 36.

FIG. 4 illustrates an alternative detente arrangement wherein convex side edges 42 on the side plate 16 mate with corresponding concave grooves 44 in the main body 14. The interlocking of the side plate 16 and the main body 14 may also be accomplished by other detente arrangements.

Any number of bolts or screws 18 can be utilized. However, a guideline to follow in regard to the length of the bolts 18 is that each bolt head and shank end should not protrude from either the main body or the side plate because any protruding bolt portion may get hung up on a workpiece. One may use bolts of a sufficiently short length to abide by this guideline, or any excess bolt length may be eliminated by hacksawing off a portion of the bolt shank. Another construction guideline is that the bolts 18 should not pass into or through the tool handle 12 in order to avoid introducing any structural weaknesses into said handle. It is unnecessary to engage the handle 12 with the bolts 18 because, once the bolts have been tightened into their respective apertures 36, the handle will be squeezed between the side plate 16 and the main body 14 as if in a vise, and will be further retained within the tool head 10 by engagement with the ridges or teeth 26. The screws or bolts 18 provide an advantageous way to quickly replace a broken handle 12 by merely removing each bolt from threaded engagement within the apertures 36, followed by separation of the side plate 16 from the main body 14, and finally, removal of the handle end 20 from its place within the channel 22. This method of handle removal is both easier and quicker to execute than the prior art scenario wherein wedges joining the handle and tool head would have to be drilled out or otherwise painstakingly removed. Often, a prior art failure would be that the entire tool would need replaced either because a broken handle was not removable from its associated tool head or because a new handle was not readily installable within a handleless tool head. Advantageously, with the present invention, a new tool handle 12 is easily installed by placing a handle end 20 within the channel 22, mating the side plate 16 with the main body 14 such that the handle end 20 is accommodated within the channel 24 as well as within a cavity defined by the channels 22 and 24, and finally, installing a plurality of bolts 18 to secure the side plate to the main body with the handle captured therebetween. Beneficially, the inventive tool head 10 of the present invention is compatible with most conventional tool handles.

In order to facilitate separation of the side plate 16 from the main body 14 following removal of all bolts or screws 18, one or more slots 46 (best seen in FIG. 1) are provided to allow for insertion of a screwdriver, or the like, between the side plate and the main body. The slots 46 are preferably defined along the top edge 28 of the tool head 10, however, other locations for at least one slot 46 are acceptable provided that the slot 46 is accessible from an exterior surface of the tool head 10 and allows insertion of a secondary tool (such as a screwdriver) between portions of the side plate 16 and the main body 14. It may be necessary to use a screwdriver, or the like, inserted into the slot 46, as a lever to quickly pry apart the side plate 16 and the main body 14 in order to overcome the secure union cooperatively achieved by both the detente arrangement (of the tabs 32 in the slots 30, or of the convex edges 42 in the concave grooves 44) and the engagement of the protrusions or ridges 26 with the handle end 20. The slot or slots 46 are cooperatively defined by the union of the side plate 16 and the main body 14. To achieve this definition of the slot or slots 46, a preferably rectangular recess may be provided in the side plate 16 (as in FIGS. 3 and 4), or a recess may be provided in the main body 14. Alternatively, the slot or slots 46 may be cooperatively defined by one or more recesses in the side plate 16 which align with one or more recesses in the main body 14. That is, a slot 46 may be provided by mating a recess in the side plate with a corresponding recess in the main body.

The present invention can be embodied in a number of alternative ways. For example, the drawings illustrate an arrangement wherein the bolts or screws 18 pass through the side plate and into the main body in an orientation that has the shank of each bolt aligned substantially perpendicular to the longitudinal axis of the tool handle 12. However, alternatively, the bolts 18 could screw down into the top edge 28 of the tool head such that the shank of each bolt engages portions of the side plate 16 and the main body 14 in an orientation wherein the shank is aligned substantially parallel with the longitudinal axis of the tool handle 12. Wing nuts could be employed as the bolts 18.

Further, the division of the tool head 10 into a main body and a removable section (the side plate) can be such that the main body and removable section are two pieces of more equal size, rather than the illustrated embodiment showing a larger main body 14 and a smaller side plate 16. Moreover, the removable side plate 16 can be configured in a variety of shapes provided that said side plate mates appropriately with the main body 14. One guideline to follow is that, when the improved tool head 10 is to be an axe, the bit, or cutting edge, of the axe should be comprised of a continuous surface (for high impact strength and structural integrity) rather than being comprised of two mated surfaces. Similarly, when the improved tool head 10 is to be a hammer, any hammer portions that are subject to impact against a workpiece should be defined by a continuous surface rather than by two mated surfaces. In accordance with this guideline, note in FIGS. 1-4 that the cutting edge of the axe is defined solely by a continuous edge surface of the main body 14, rather than being cooperatively defined by portions of both the side plate 16 and the main body 14. As noted previously, the inventive concept presented herein may be embodied in types of tool heads other than the axe head shown in the drawings.

From the foregoing, it will be appreciated that the improved tool head of the present invention advantageously allows a broken tool handle to be replaced relatively easily and quickly so that the tool head can be salvaged for further use with a new handle. The present invention eliminates the need to replace both tool head and handle, thereby allowing a tool owner to avoid extra expense. Moreover, a craftsman having a spare handle readily available can avoid prolonged downtime following handle breakage by repairing the tool on-site, rather than having to purchase an entire new tool or having to painstakingly remove a broken handle that has been joined to a tool head in a more permanent manner using prior art methods such as wedges.

While several particular forms of the invention have been illustrated and described, it will also be apparent that various modifications can be made without departing from the spirit and scope of the invention. Accordingly, it is not intended that the invention be limited, except as by the appended claims.

I claim:

1. An improved tool head adapted for attachment to a handle; said tool head comprising:

a tool head assembly comprised essentially only of a first member and a second member;

said first member having at least one end portion adapted for use in striking a workpiece, said first member further including a first channel portion configured to accommodate at least a portion of the handle in a removable manner;

said second member having a second channel portion configured to accommodate at least a portion of the handle in a removable manner, wherein said second member is configured for removable interlocking engagement with said first member, said first and second members are capable of being joined in an interlocking fashion such that said first and second channel portions cooperatively define a cavity that lies within said tool head assembly, said cavity having a configuration for accommodating at least a portion of the handle therein; and securing means for attaching said second member to said first member such that securement of said first and second members with the handle accommodated within said cavity will retain said handle therein, and wherein said securement means allows for separation of the tool head assembly merely by releasing the securement means and only separating said first and second members in order that a handle portion accommodated within said cavity may be removed therefrom.

2. An improved tool head as set forth in claim 1, wherein said securement means comprises one or more screws.

3. An improved tool head as set forth in claim 1, wherein said first channel portion includes means for releasably engaging a handle portion accommodated therein.

4. An improved tool head as set forth in claim 1, wherein said second channel portion includes means for releasably engaging a handle portion accommodated therein.

5. An improved tool head as set forth in claim 1, wherein said at least one end portion of the first member is configured as a sharpened axe edge.

6. An improved tool comprising:

an elongate handle, and a tool head being comprised of:

a first member having at least one work engaging end portion, said first member further including a first channel portion configured to accommodate at least a portion of the handle in a removable manner;

a second member having a second channel portion configured to accommodate at least a portion of the handle in a removable manner, wherein said second member is configured for removable engagement with said first member, wherein said first and second members are mated in an engagement such that said first and second channel portions cooperatively define a cavity that lies within said tool head, said cavity accommodating at least a portion of the handle therein; and attachment means for securing said second member to said first member without engaging or being attached to said handle such that engagement of said first and second members with the handle accommodated within said cavity will retain said handle therein, and wherein said attachment means allows for separation of said first and second members in order that the first and second members can be separated merely by releasing the attachment means so that the handle portion accommodated within said cavity may be removed therefrom.

7. The invention as set forth in claim 6, wherein said cavity within said tool head accommodates the handle in an orientation wherein said tool head defines top and bottom surfaces each having at least a portion thereof that is oriented substantially perpendicular to the longitudinal axis of said handle, and said tool head also defines at least one side surface that is oriented substantially parallel to the longitudinal axis of said handle, and wherein said second member defines, at least in part, a side surface that is oriented substantially parallel to the longitudinal axis of said handle.

8. The invention as set forth in claim 6, wherein one of said first or second members has projections which fit into corresponding recesses in the other of said first and second members, and said means for attaching said first and second members comprises fasteners which extend through the projections on one of said members and and engage the other one of said members.

9. The invention as set forth in claim 6, wherein at least one of said channel portions includes means for releasably engaging the handle portion accommodated therein.

10. An improved tool head adapted for attachment to a handle; said tool head comprising:

a first member having at least one edge portion adapted for use in striking a workpiece, said first member further including a first channel portion configured to accommodate at least a portion of the handle in a removable manner;

a second member having a second channel portion configured to accommodate at least a portion of the handle in a removable manner, wherein said second member is configured for removably interlocking with said first member, wherein said first and second members join in an interlocking fashion such that said first and second channel portions cooperatively define a cavity that lies within said tool head, said cavity having a configuration for accommodating at least a portion of the handle therein;

attachment means for attaching said second member to said first member such that attachment of said first and second members with the handle accommodated within said cavity will retain said handle therein, and wherein said attachment means allows for separation of said first and second members in order that a handle portion accommodated within said cavity may be removed therefrom; and a plurality of sharpened protrusions in said first channel portion for releasably engaging a handle portion which is accommodated therein, said sharpened protrusions being adapted to bite into and grip a wooden handle accommodated within said first channel portion.

11. An improved tool head as set forth in claim 10, wherein a plurality of sharpened protrusions within said second channel portion are adapted to bite into and grip a wooden handle portion accommodated within said second channel portion.

12. An improved tool head adapted for securement to a handle; said tool head comprising:

a first member having at least one edge portion adapted for use in striking a workpiece, said first member further including a first channel portion configured to accommodate at least a portion of the handle in a removable manner;

a second member having a second channel portion configured to accommodate at least a portion of the handle in a removable manner, wherein said second member is configured for removably interlocking with said first member, wherein said first and second members join in an interlocking fashion such that said first and second channel portions cooperatively define a cavity that lies within said tool head, said cavity having a configuration for accommodating at least a portion of the handle therein;

means for attaching a second member to said first member such that attachment of said first and second members with the handle accommodated within said cavity will retain said handle therein, and wherein said attachment means allow for separation of said first and second members in order that a handle portion accommodates within said cavity may be removed therefrom; and said first and second members being configured such that the attachment of said first and second members forms a union of said members in an interlocking fashion and which union further defines at least one slot that is accessible from an exterior surface of said tool head, said at least one slot being located and configured to allow for the insertion of a screwdriver, or the like, between said first and second members so that said members may be readily separated whenever such separation is allowed by the attachment means.

13. An improved axe comprising:

an elongated handle, and an axe head comprising:

a first member having at least one cutting edge portion, said first member further including a first channel portion configured to accommodate at least a portion of the handle in a removable manner;

a second member having second channel portion configured to accommodate at least a portion of the handle in a removable manner and where said second member is configured for removable engagement with said first member, wherein said first and second channel portions cooperatively define a cavity that lies within said axe head, said cavity accommodating at least a portion of the handle therein; and at least one bolt for securing said second member to said first member, said bolt being a head retained within one of said members and a bolt shank which threads into a threaded opening in the other of said members, such that engagement of said first and second members with the handle accommodated within said cavity will retain said handle therein, and wherein said bolt allows for separation of said first and second members in order that the handle portion accommodated within said cavity may be removed therefrom.

14. An improved axe comprising:

an elongated handle comprised of an non-metallic material; and an axe head comprising:

a first member having at least one cutting edge portion, said first member further including a first channel portion configured to accommodate at least a portion of the handle in a removable manner;

a second member having a second channel portion configured to accommodate at least a portion of the handle in a removable manner, wherein said second member is configured for removable engagement with said first member, such that said first and second members are mated in an engagement where said first and second channel portions cooperatively define a cavity that lies within said axe head, said cavity accommodating at least a portion of the handle therein;

securing means for securing said second member to said first member such that engagement of said first and second members with the handle accommodated within said cavity will retain said handle therein, and wherein said securing means allows for separation of said first and second members in order that the handle portion accommodated within said cavity may be removed therefrom; and gripping means in at least one of said channel portions for releasably engaging the handle portion accommodated in that channel portion, said gripping means comprising a sharpened ridge adapted to bite into and grip the handle portion accommodated within said cavity.

15. An improved axe comprising:

an elongate handle, and an axe head comprising:

a first member having at least one cutting edge portion, said first member further including a first channel portion configured to accommodate at least a portion of the handle in a removable manner;

a second member having a second channel portion configured to accommodate at least a portion of the handle in a removable manner;

a second member having a second channel portion configured to accommodate at least a portion of the handle in a removable manner and where said second member is configured for removable engagement with said first member, and said first and second members are mated in an engagement wherein said first and second channel portions cooperatively define a cavity that lies within said axe head, said cavity accommodating at least a portion of the handle therein;

securing means for securing said second member to said first member such that engagement of said first and second members with the handle accommodated within said cavity will retain said handle therein, and wherein said securing means allows for separation of said first and second members in order that the handle portion accommodated within said cavity may be removed therefrom; and said first and second members being configured such that engagement of said members further defines at least one opening that is accessible from and exterior surface of said axe head, said at least one opening being located and configured to provide means for allowing the insertion of a screwdriver, or the like, between said first and second members so that said members may be readily separated whenever such separation is allowed by the securing means.

16. An improved tool comprising:

an elongated handle, and a tool head comprised of:

a first member having at least one work engaging end portion, said first member constituting the main member of the tool head and having a channel portion configured to accommodate at least a portion of the handle in a removable manner;

a second member adapted for mating engagement with said first member and enclosing said channel portion when secured to said first member, such that when said first and second members are mated in the engagement they define a complete cavity that lies within said tool head, and said cavity accommodating at least a portion of the handle therein; and securing means for securing said second member to said first member such that engagement of said first and second members with the handle accommodated within said cavity will retain said handle therein, and wherein said securing means allow for separation of said first and second members in order that the handle portion accommodated within said cavity may be removed therefrom.

17. The invention as set forth in claim 16, wherein said handle is comprised of a non-metallic material and wherein said means for releasably engaging the handle portion comprises at least one sharpened ridge adapted to bite into and grip the handle portion accommodated within said cavity.

18. The invention as set forth in claim 16, wherein said first and second members are configured such that engagement of said members further defines at least one opening that is accessible from an exterior surface of said tool head, said at least one opening being located and configured to provide means for allowing the insertion of a screwdriver, or the like, between said first and second members so that said members may be readily separated whenever such separation is allowed by the securing means.

* * * * *